US005493799A

United States Patent [19]

Foo

[11] Patent Number: 5,493,799

[45] **Date of Patent: *Feb. 27, 1996**

[54] STEAM IRONING PRESS WITH MOTOR AND RELAY CONTROL

[75] Inventor: Man Y. Foo, Quarry Bay, Hong Kong

[73] Assignee: The Singer Company N.V., Curaco, Netherlands Antilles

[ * ] Notice: The term of this patent shall not extend beyond the expiration date of Pat. No. 5,348,767.

[21] Appl. No.: 241,541

[22] Filed: Jan. 26, 1994

Related U.S. Application Data

[62] Division of Ser. No. 61,100, May 10, 1993, Pat. No. 5,349,767.

[51] Int. Cl.[6] ..... D06F 71/34; D06F 71/36

[52] U.S. Cl. ..... 38/16; 38/DIG. 1

[58] Field of Search ..... 38/1 C, 3, 14, 38/17, 71, 77.5, 77.8, 77.9, 16; 335/68, 69, 70, 78, 80; 417/5, 12, 15, 32, 415

[56] References Cited

U.S. PATENT DOCUMENTS

| | | | |
|---|---|---|---|
| 1,842,784 | 1/1932 | Houston | 38/16 X |
| 1,849,033 | 3/1932 | Davis | 38/16 |
| 1,881,581 | 10/1932 | Hoffman | 38/16 |
| 2,307,370 | 1/1943 | Hale | 38/16 X |
| 4,352,252 | 10/1982 | Brenot | 38/16 |
| 4,744,160 | 5/1988 | Elliott et al. | 38/16 |
| 4,922,637 | 5/1990 | Davidson et al. | 38/15 |
| 5,349,767 | 9/1984 | Foo | 38/16 |

FOREIGN PATENT DOCUMENTS

| | | | |
|---|---|---|---|
| 0555534 | 11/1991 | European Pat. Off. | 335/69 |
| 3001609 | 1/1993 | WIPO | 335/69 |

*Primary Examiner*—C. D. Crowder
*Assistant Examiner*—Ismael Izaguirre
*Attorney, Agent, or Firm*—McCormick, Paulding & Huber

[57] ABSTRACT

A steam press for pressing fabric is disclosed. The press includes a piston pump which draws water out of a water reservoir and forces the water into a water inlet port of the press. The pump is operated by a direct current motor which is coupled to the piston of the pump by a drive shaft. The piston is caused to slide back and forth by means of first and second relays coupled between a source of direct current and the motor. The first and second relays apply, respectively, direct voltage of a first polarity and a second reverse polarity to the motor.

8 Claims, 8 Drawing Sheets

| FIG. 10A | FIG. 10B |
|---|---|

STEAM IRONING PRESS WITH MOTOR AND RELAY CONTROL

This is a division of application Ser. No. 08/061,100 filed on May 10, 1993, now U.S. Pat. No. 5,349,767.

BACKGROUND OF THE INVENTION

Known portable steam ironing presses, as disclosed for example in U.S. Pat. No. 4,955,152, employ a fixed lower member and an upper member manually movable upward to a position spaced above the lower member and downward into engagement with the lower member. An article to be pressed is disposed between the members when separated and is squeezed therebetween when the members engage. The article is pressed using heat and steam supplied with appropriate timing via the upper member.

Such known presses use pumps to inject water under pressure into electrically heated regions wherein the water is converted into steam. The pump is mechanically actuated.

The present invention is directed toward a new type of steam ironing press wherein the pump is actuated by a direct current motor, and all functions other than the movement of the upper and lower members and seeing of manually adjustable controls are programmed and controlled electronically.

SUMMARY OF THE INVENTION

In accordance with the principles of the invention, a steam press adapted to press an article of fabric utilizes a lower stationary horizontal member and an upper movable horizontal member, the press having an open position at which the upper member is spaced above the lower member and having a closed position at which the upper member engages the lower member. Fabric to be pressed is disposed between the two members.

The upper member has a water inlet port, and first means including at least one electrically energizable element adapted to heat the surface of said upper member adjacent the lower member and when water is delivered to the inlet port to heat said water into steam, and bottom disposed steam outlet ports for discharging the steam into the fabric being pressed.

The press contains a water reservoir and a pump for pumping water out of the reservoir into the water inlet of the upper member. The pump has a pump body having an inlet into which water is drawn by suction from the reservoir and an outlet through which water is expelled under pressure into the water inlet. The pump also has a piston movable therein. The pump is powered by a direct current motor having a drive shaft which rotates in one direction when a direct voltage of selected polarity is applied to the motor and which rotates in opposite direction when the polarity of the applied voltage is reversed. The piston is coupled to the shaft and moves back and forth in the body in accordance with the direction of rotation of the drive shaft to developed the suction or expelling force.

Second means is coupled to the pump and to the first means. The second means controls the timing and application of the direct voltages of different polarities to the pump motor and regulates the flow of current through the electrical heating element whereby steam is produced as required.

The foregoing and other functions of the press, other than the movement of the upper and lower members and setting of manually adjustable controls, are programmed and controlled electronically. As a result, a press in accordance with the invention exhibits a substantial increase both in ease of operation and in accuracy and efficiency of pressing as compared to known portable steam iron presses.

Additional features and advantages of this invention will either be explained or will become apparent hereinafter.

DETAILED DESCRIPTION OF PREFERRED EMBODIMENT

Figure 1:
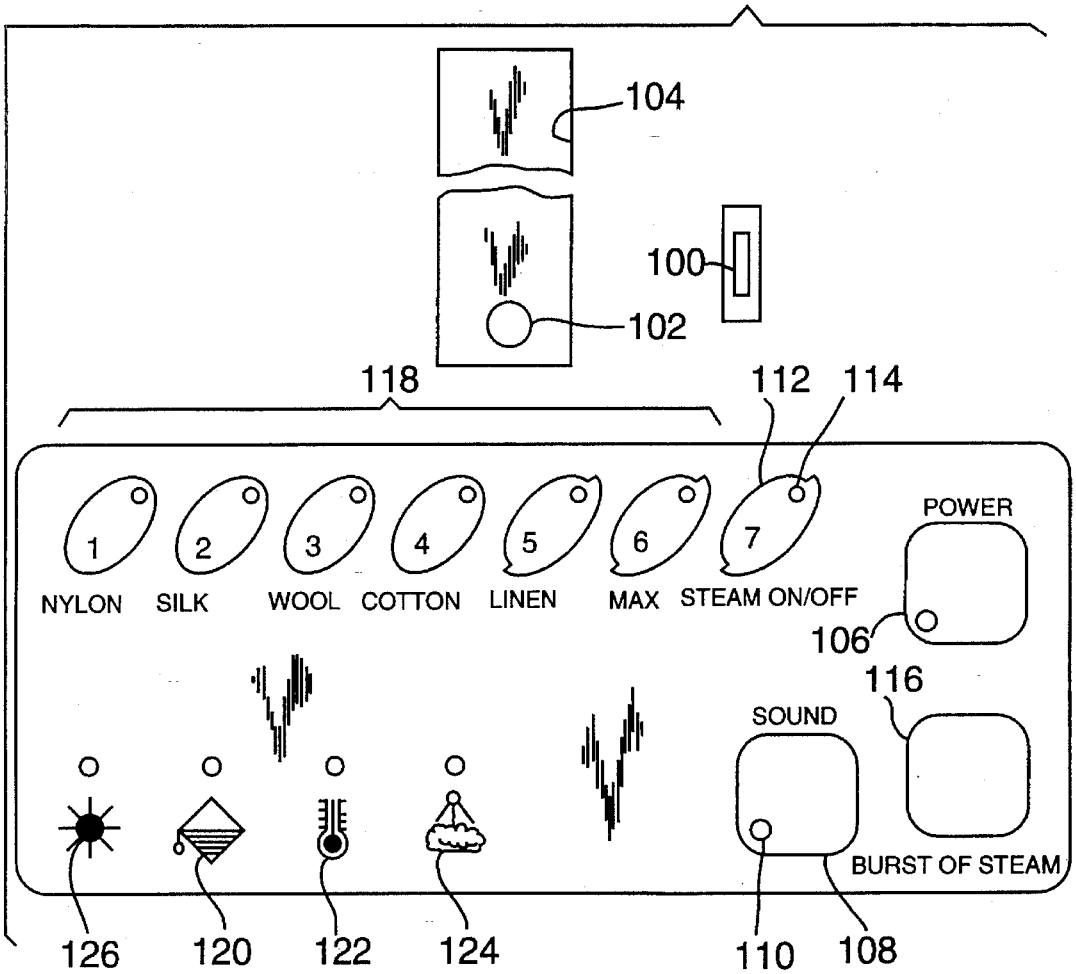
FIG. 1 is a detail front view of externally disposed switches, steam volume control and LEDs employed in a preferred embodiment of the invention.

Referring first to FIG. 1, the press employs the following elements; a steam volume lever 100 which is manually moved to set the steam volume from zero volume to full volume; a water reservoir or tank fill cap 102; a water level window 104 which displays the water level in the tank; a power on-off button 106; a sound on-off button 108 which when depressed cuts off sound and when depressed again turns the sound on; a sound indicator LED 110 which lights up when the sound is on; a steam on-off button 112 which when turned off prevents formation of steam and when turned on makes steam available when the temperature is high enough; a steam on-off indicator LED 114 which lights up when the steam on-off button is turned on to indicate that steam is available when the temperature is high enough and when dark indicates that steam is not available; a burst of steam button 116 which can be pressed for an additional injection of steam when the iron temperature is equal to that of LINEN or higher; a temperature select button matrix 118 which can be used to select any one of six different temperatures for materials indicated, each button having a temperature select indicator LED which lights up to identify the selected temperature and flashes when the temperature is rising to that selected; an automatic shut off indicator LED 126 which lights up when the heater and the pump motor are automatically shut off; a low water level indicator LED 120 which lights up when the level of water in the reservoir is too low; a temperature ready indicator LED 122 which lights up when the selected temperature is reached and flashes when the press is heating or cooling to reach the selected temperature; and a steam ready indicator LED 124 which lights up when the press is ready for steam ironing.

Figure 2:
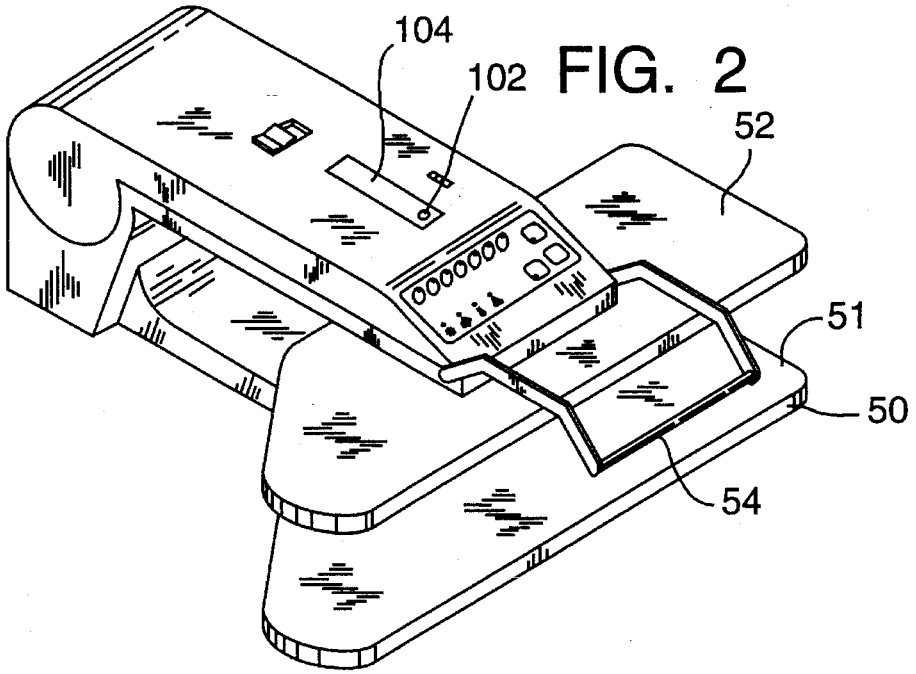
FIG. 2 is a front perspective view of the embodiment of FIG. 1.
Figure 3:
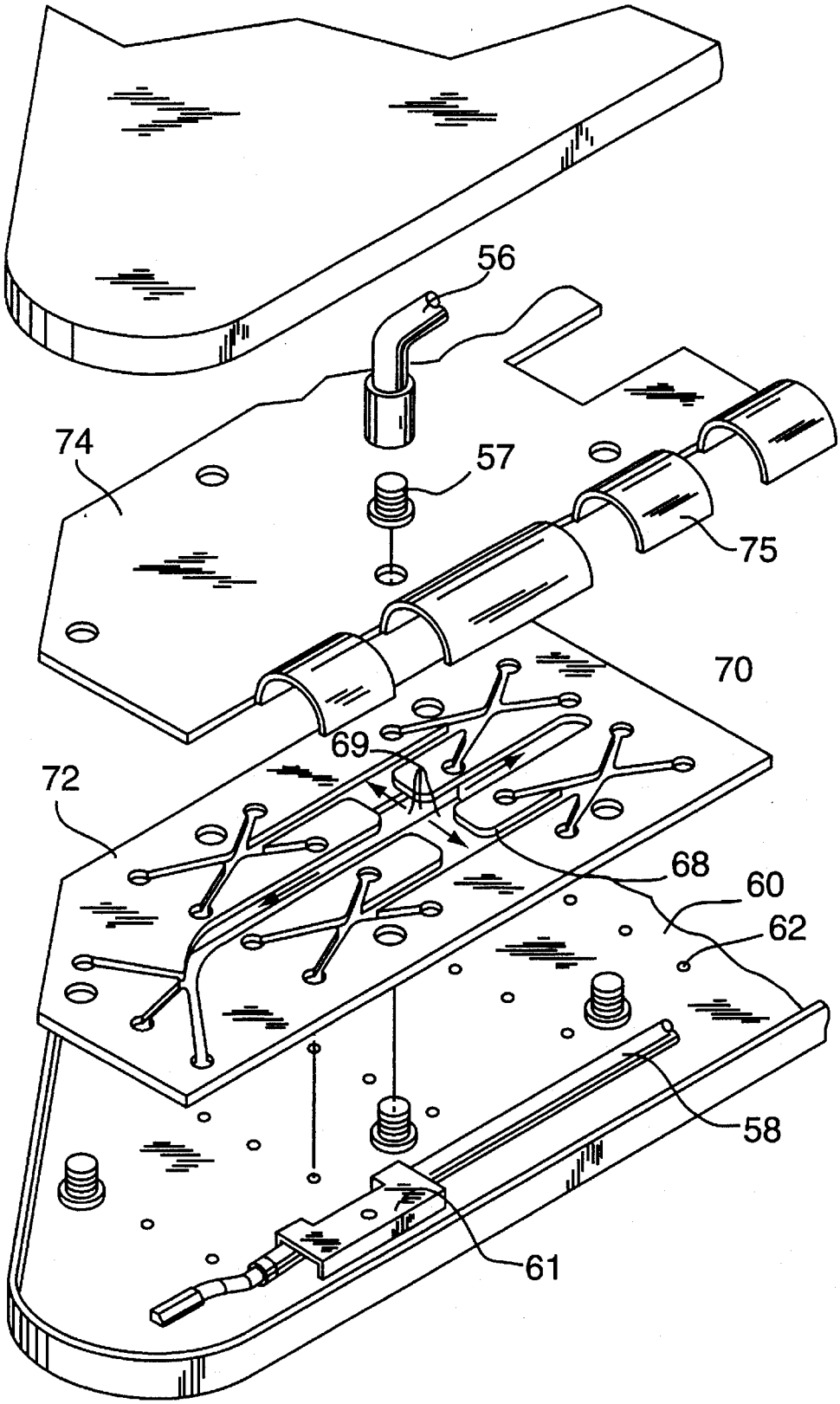
FIG. 3 is an exploded view of the movable upper member shown in FIG. 2
Figure 4:
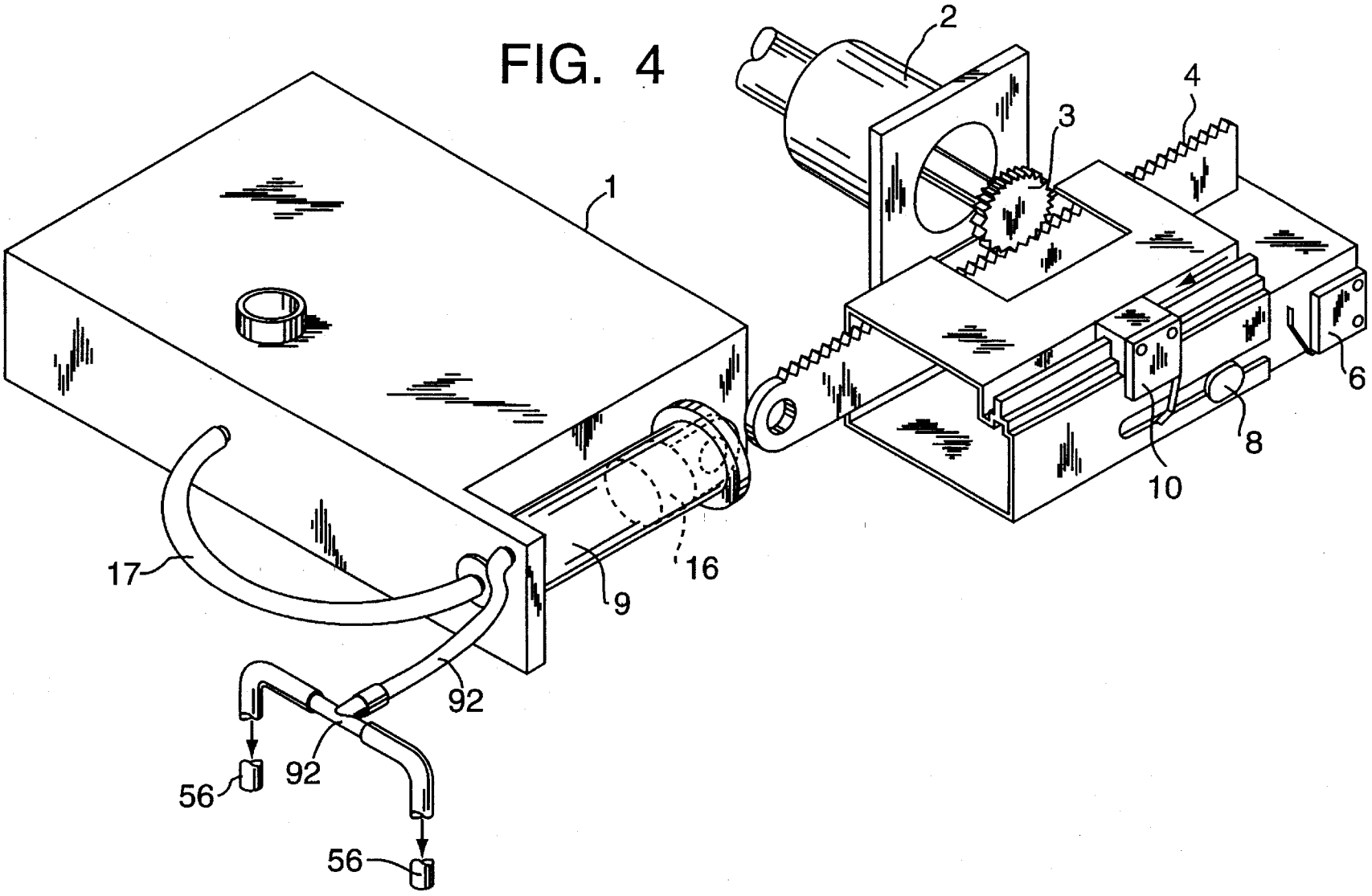
FIGS. 4, 5, 6 and 7 are different views of the pump and water reservoir used in the embodiment of FIG. 1.
Figure 5:
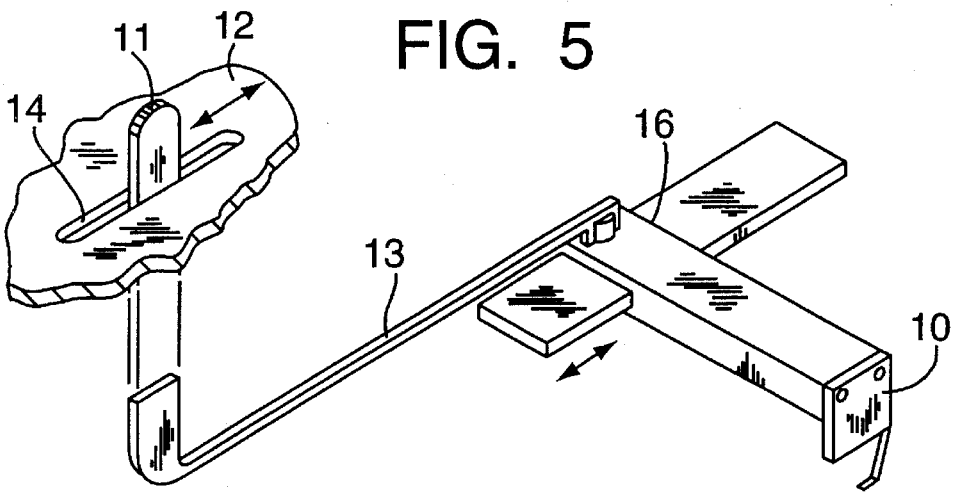
Figure 6:
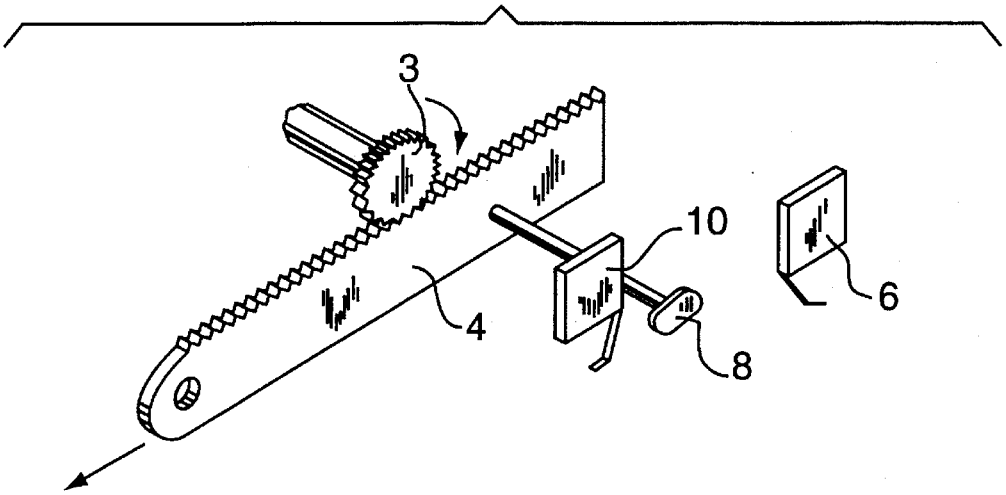
Figure 7:
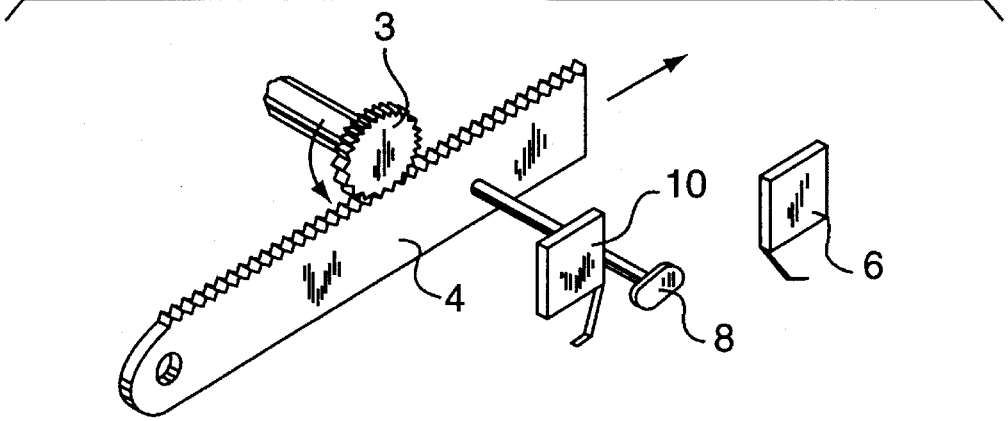
Figure 8:
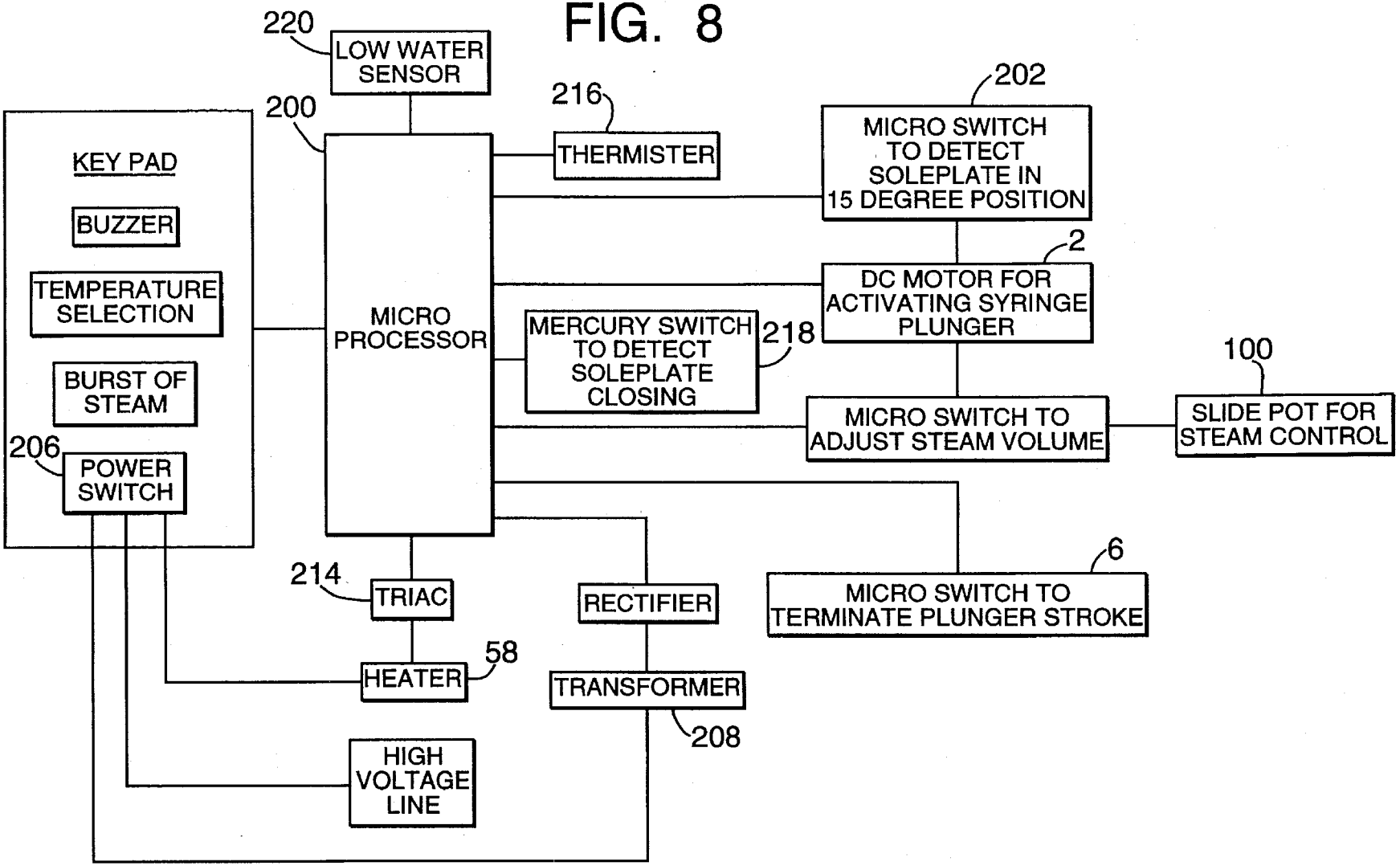
FIGS. 8 and 9 are block diagrams of the electrical control system used in the embodiment of FIG. 1.
Figure 9:
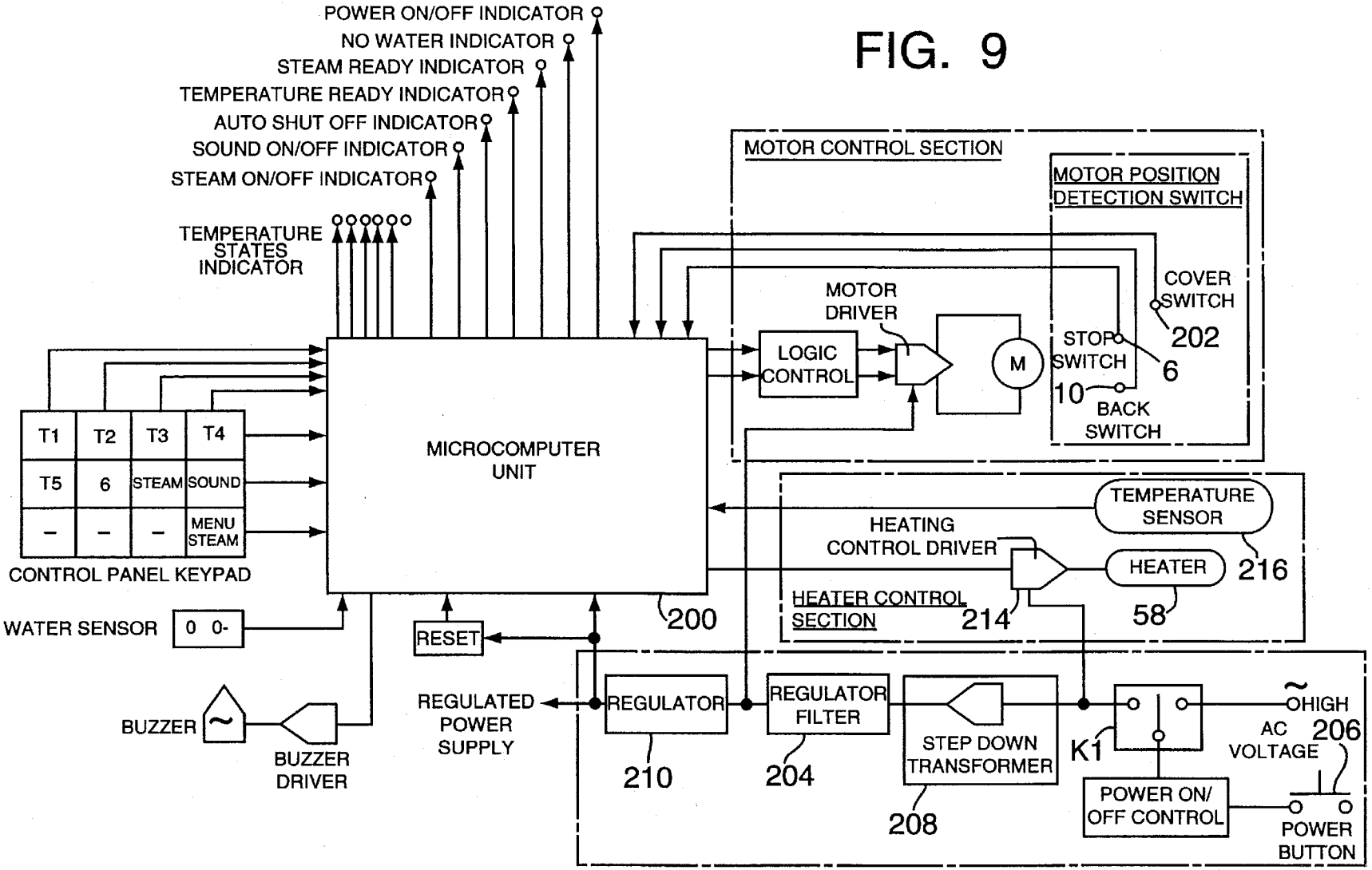
Figure 10A:
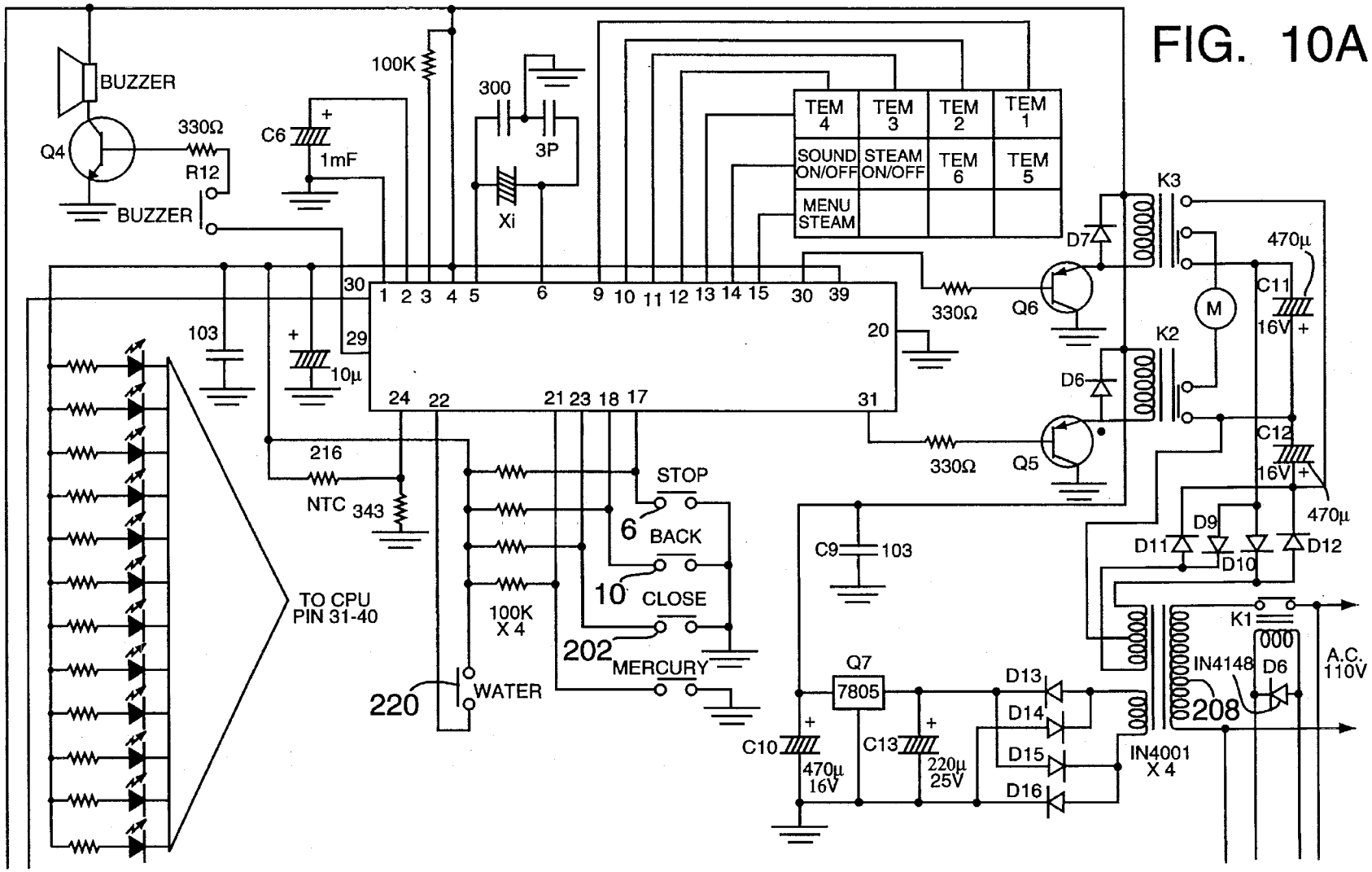
FIG. 10 is a circuit diagram of the system shown in block diagramatic form in FIGS. 8 and 9.
Figures 10, 10B:
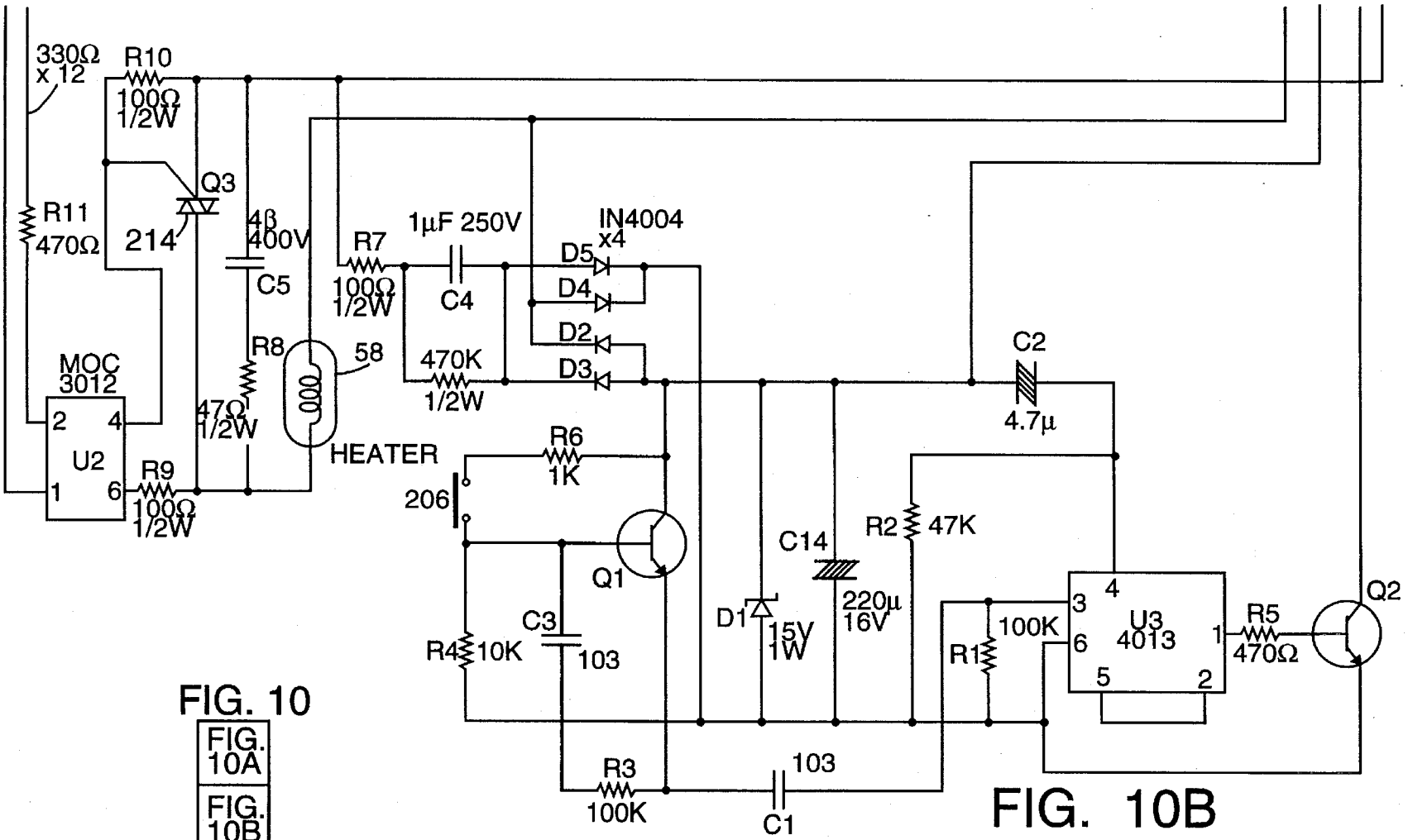

Referring now to FIGS. 2 and 3, the press employs a stationary lower member 50 having an exposed upper surface 51 and a movable upper member 52 containing an ironing plate or platen 60 having an exposed lower surface. Plate 60 contains holes 62 through which steam can flow. A handle 54 secured to member 52 can be used to manually move the member 52 toward and away from member 50. The handle and members are so balanced that the handle can be used to move the member 52 to any position between maximum separation and minimum separation with respect to member 50.

A labyrinth plate 72 is disposed between platen 60 and an upper cover plate 74. Place 72 contains pathways or cut out channels which terminate in outlet holes 70. Holes 70 are aligned with holes 62 in the platen. The formed labyrinth has a thickness on the order of one millimeter. The longitudinal edges of plate 72 are inwardly offset from the platen. The platen carries one or more electrically energized elongated heating rods 58 which are held in place by a plurality of clamps 61. Curved members 75 integral with the cover plate 74 are positioned over the clamps so that heat emitted from the upper portions as well as the lower portions of rods 58 is directed downward upon the plate 72 and platen 60. If desired, another rod can be disposed along the opposite longitudinal edge of plate 72 and be supported by additional elements 75 in the same manner.

When water is pumped downwardly through pipes 56 and fittings 57 into the central cruciform region 59 of channels 68, water droplets in the channels are forced by their affinity to the heated surfaces to advance through the labyrinth gaining heat and deteriorating in size and are converted to steam prior to emission via holes 70. Consequently steam is discharged through the platen openings. The force of discharge of steam is generated by the thermodynamic pressure of the process.

Referring now to FIGS. 3–10, water to be converted into steam is stored in reservoir or tank 1 and a pump is used draw water out of tank 1 via inlet hose 17 and to pump water via outlet hose 18 and discharge tee 92 into pipes 56.

The pump is a syringe 9 with a movable piston 16. A direct current motor 2 is reversible and can be made to rotate either clockwise or counterclockwise by reversing the polarity of the voltage applied to the motor.

A pinion gear 3 is secured to the motor shaft and rotates therewith. The pinion gear engages a rack gear 4. One end of the rack gear is secured to piston 16 in a syringe.

The rack gear has a rod 8 secured thereof, the rod extending outwardly at right angles to the rack gear. The rod has a tip. Initially, the rack is in its rearmost position, the piston is in fully withdrawn position, the syringe contains a full charge of water and the motor has stopped. The tip of the rod is in its rearmost position and engages a microswitch 6 When this switch is closed, the motor is inoperative.

The motor is initially inoperative and the piston is fully withdrawn. The syringe is filled with water. When the press is in use and the upper member is moved downward to a position of about 15 degrees above the horizontal, the upper member closes another microswitch 202. This action sends a signal to the microprocessor 200 which in turn sends a signal and actuating a selected one of relays K2 and K3. A direct voltage of suitable polarity and value, typically about thirty two volts, is supplied from the output of regulator filter 204 through the closed contacts of the actuated relay to the motor which then rotates clockwise.

As the motor rotates clockwise, the pinion gear advances the rack, the rod is moved forward and the tip is moved out of engagement with the microswitch 6 which opens. As the motor continues to rotate, the forward movement of the rack advances the piston in the syringe and forces water out of the syringe via the outlet hose into the steam generation section of the upper member. Once the preselected amount of water is forced out, the tip of the rod which has also been advanced engages a second microswitch 10. This action sends a signal to the microprocessor which then sends a signal to the relays, deactuating the previously selected relay and actuating the previously unselected relay. The same direct voltage with the same polarity passes through the closed contacts of the now actuated relay, but due to the reversal of connections between the contacts and the relay, the voltage is applied to the motor with reverse polarity. The motor first stops and then begins to rotate counterclockwise.

This reversal of motor rotation reverses the action and the motor, rack, piston and rod return to their original positions. During this reversal, a suction action draws water from the reservoir, through the inlet hose and into the syringe. Finally, the tip of the rod engages the first microswitch 6, sending a signal to the microprocessor which then sends a signal deactuating both relays and the motor is caused to stop.

If an additional burst of steam is required at this point, depression of the burst of steam button 116 will send the same signal to the microprocessor that is produced by closure of microswitch 202 and the cycle for producing steam will be repeated.

When the steam cut off button is depressed, a signal is sent to the microprocessor which then sends a signal deactuating both relays K2 and K3, thus preventing the pump from operating. The bar will continue to produce heat even when steam is not required.

The amount or volume of water injected into the syringe can be varied by adjusting the position of microswitch 10 to lengthen or shorten the distance the piston travels and thus increase or decrease the water volume. This action is carried out using lever 13 connected to the manually adjustable prong 11. When the prong is moved along the slot on the cover 12, microswitch bracket 16 and microswitch 10 will follow the movement. The movement is limited by the length of the slot 14. The steam volume lever 100 is connected to the prong, thus enabling a press operator to make the desired adjustment.

When the power on-off button 106 is depressed, switch 206 is closed, the power on-off relay K1 is closed and the conventional mains voltage of one hundred and fifteen volts is applied across the primary winding of step down transformer 208. The voltage across the secondary winding is rectified and filtered as shown at regulator filter 204 [which comprises a rectifier filter]. The output of regulator filter 204 is connected to a voltage regulator 210, which produces a regulated direct voltage of lower value typically about five volts. This regulated direct voltage is supplied to the microprocessor 200.

The alternating voltage applied to the primary of transformer 208 is also supplied to the heater bar or bars 58. The temperature selection matrix 118 is connected as an input to the microprocessor 200 and the microprocessor has an output connected via a control driver or isolating amplifier 212 to an optical triac 214. The triac regulates the portion of the alternating current cycle during which current flows through the bar 58 to regulate the heat produced in the press in accordance with the selected temperature. As the temperature selected increases, the portion of the cycle increases and as the temperature selected decreases, portion of the cycle decreases accordingly. A thermistor 216 senses the actual temperature and sends an appropriate signal to the microprocessor which then sends an appropriate control signal via amplifier 212 to the triac. The resistance of this sensor decreases with increasing temperature. When the temperature reaches the desired value, or exceeds it, signal supplied to the triac will cause the triac to cut off current flow through the bar.

The press incorporates an automatic safety shut off functions. When the handle of the press is in the down position so that the press is closed, if the press remains closed longer than thirty seconds, the current flow through the heater is cut off, thus preventing excessive temperature build up. At the same time, the voltage applied to the motor is removed, stopping motor rotation. When the handle of the press is in the up position so that the press is open, if the press remains open for longer than fifteen minutes, the same events will ensue. The current flow through the heater will be cut off and motor rotation will stop. In either situation, the closed press must be opened or the opened press must be closed after shut off in order to restart normal operation.

Mercury switch 218 is used to initiate and control the timing of the automatic safety shut off functions. This switch is closed when the press is opened and is open when the press is closed. This switch signals its open or closed position as an input signal to the microprocessor. There are two timing circuits, a thirty second timing circuit defined by normally conductive transistor Q1 and associated diode, capacitor and resistor passive components, and a fifteen minute timing circuit defined by normally conductive transistor Q2, timer integrated circuit U3 and associated passive components. The microprocessor responds to the input signal to send a signal to the appropriate timing circuit and actuate it. If the operation of the press is maintained within the appropriate limits, the mercury switch will change from open to closed or closed to open, causing the microprocessor to deactuate the timer before its limits are reached. However, if the operation of the press exceeds the limits defined by the actuated circuit, the appropriate one of transistors Q1 and Q2 will be rendered nonconductive, deactuating relay K1 and disabling the motor and heater bar.

A water sensor switch 220 is disposed in the water tank. This switch is normally open. When the water lever falls below the desired minimum level, this sensor switch closes, sending a signal to the microprocessor which then sends a signal to LED 120 which lights to alert the user that the water level is too low.

The sound button controls switch 220 which is connected in circuit with a buzzer 222. When switch 220 is open, no sound will be produced. When switch 220 is closed, the buzzer will sound when an appropriate signal is supplied from the microprocessor. The microprocessor can send such signal for example,when the water level is too low or when the power is turned on. Once the buzzer sounds, switch 220 must be opened before the buzzer will be turned off.

While the invention has been described with particular reference to the preferred embodiment and the drawings, the protection sought is to be limited only by the terms of the claims which follow.

What is claimed is:

1. A steam press for pressing fabric comprising:

a water inlet port;

a water reservoir having a water outlet port;

a pump having a longitudinally elongated pump body with an inlet connected to the reservoir outlet and an outlet connected to the water inlet port in said press, said body having a piston longitudinally slidable back and forth therein;

a direct current motor having a drive shaft coupled to said piston, said shaft rotating in a first direction when a direct voltage of a first polarity is applied to the motor to cause the piston to slide longitudinally in the pump body in a direction to draw water out of the reservoir into the pump body, said shaft rotating in a second and reversed direction when a direct voltage of a second and reversed polarity is applied to said motor to cause the piston to slide longitudinally in the pump body in reversed direction to force water out of the reservoir into the inlet port, the shaft rotation being stopped when no direct voltage is applied to the motor;

a source of said direct voltage, said source having a selected one of said first and second mutually opposed polarities; and first and second relays coupled between said source and said motor, the first relay when actuated while the second relay is deactuated applying said direct voltage with said first polarity to said motor to cause water to be drawn out of the reservoir into the pump body, said second relay when actuated while the first relay is deactuated applying said direct voltage with said second polarity to said motor to force water out of the pump body into the inlet water port, no direct voltage being applied to the motor when both relays are deactuated.

2. The press of claim 1 including a microprocessor coupled to said relays and adapted to send a selected one of first, second and third output signals thereto, the first output signal actuating the first relay and deactuating the second relay, the second output signal actuating the second relay and deactuating the first relay, the third output signal causing both relays to be deactuated.

3. The press of claim 2 wherein the piston has a first position when the pump body is full of water and a second position when the pump body has been emptied of water, the press further including piston sensing means which sends a first micropressor input signal to the microprocessor when the piston is in the first position and a second microprocessor input signal to the microprocessor when the piston is in the second position, the microprocessor responding to the first input signal to produce the third output signal and responding to the second input signal to produce the first output signal.

4. The press of claim 3 wherein said piston sensing means includes a plurality of electromechanical switches, each switch having open and closed positions.

5. The press of claim 2 further including starting means to send a third microprocessor input signal to the microprocessor when both relays have been deactuated, the microprocessor responding to the third input signal to produce the second output signal.

6. The press of claim 5 wherein the starting means includes an electromechanical switch.

7. The press of claim 1 wherein the inlet port is disposed in a housing which also includes an electrical heating element and steam output ports so that when water is supplied by the pump to the inlet port and the element is energized, the water in engagement with the element is heated into stem which flows out of the steam ports, said press also including a source of alternating current of fixed frequency and amplitude and a device connected between the current source and the element to energize it, the device including a variac.

8. The press of claim 7 further including manually adjustable means connected to said device to control the amount of heat produced by said element by controlling the percentage of time during each alternating current cycle in which current flows in said element.

* * * * *